US005105630A

United States Patent [19]

Kim

[11] Patent Number: 5,105,630

[45] Date of Patent: Apr. 21, 1992

[54] AIR CONDITIONING SYSTEM CONTAINING A PLASTIC DRAIN PAN

[76] Inventor: Chang H. Kim, 5809 Hampton Forest Way, Fairfax, Va. 22030

[21] Appl. No.: 724,798

[22] Filed: Jul. 2, 1991

[51] Int. Cl.[5] ..... F25D 21/14

[52] U.S. Cl. ..... 62/285; 62/291

[58] Field of Search ..... 62/285, 286, 272, 288, 62/291

[56] References Cited

U.S. PATENT DOCUMENTS

| | | | |
|---|---|---|---|
| 3,306,070 | 2/1967 | Herb et al. | 62/285 |
| 4,597,269 | 7/1986 | Kim | 62/286 |
| 4,823,558 | 4/1989 | Kim | 62/272 |
| 4,862,704 | 9/1989 | Kim | 62/272 |
| 4,916,919 | 4/1990 | Kim | 62/272 |
| 5,042,269 | 8/1991 | Sullivan | 62/272 |

*Primary Examiner*—Albert J. Makay
*Assistant Examiner*—William C. Doerrler
*Attorney, Agent, or Firm*—Birch, Stewart, Kolasch & Birch

[57] ABSTRACT

An air conditioning system includes an air cleaner and a plastic drain pan assembly, which contains a drain pan, a fan cover supporting bracket having a plurality of slant barriers and a radiator supporting bracket having a horizontally elongated slant valley for slantingly receiving a radiator.

5 Claims, 2 Drawing Sheets

FIG. 4
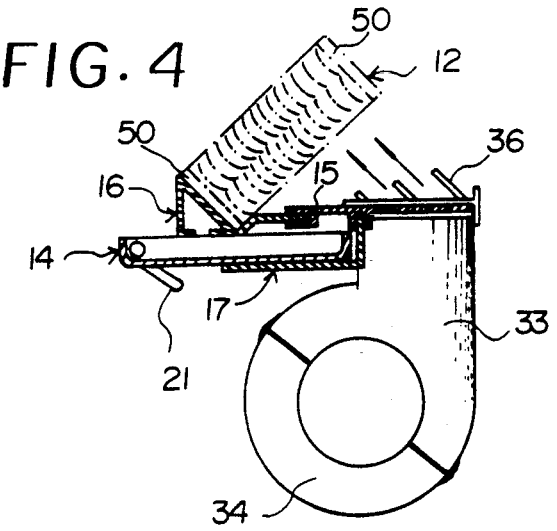
FIG. 5
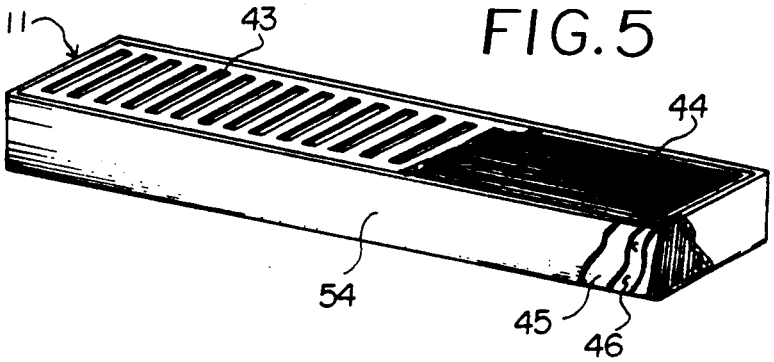
FIG. 6
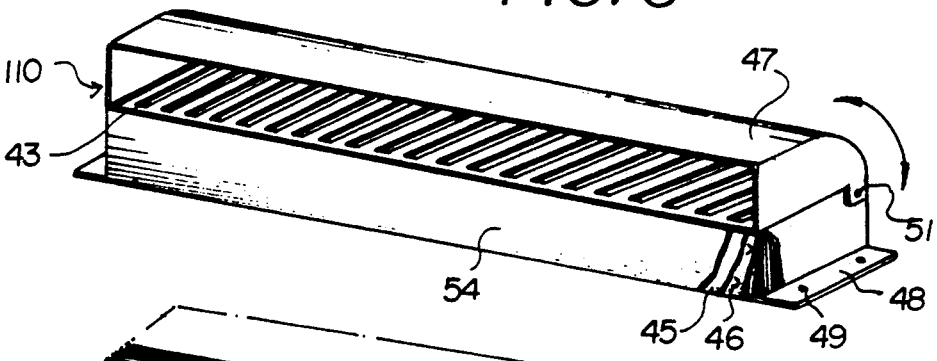
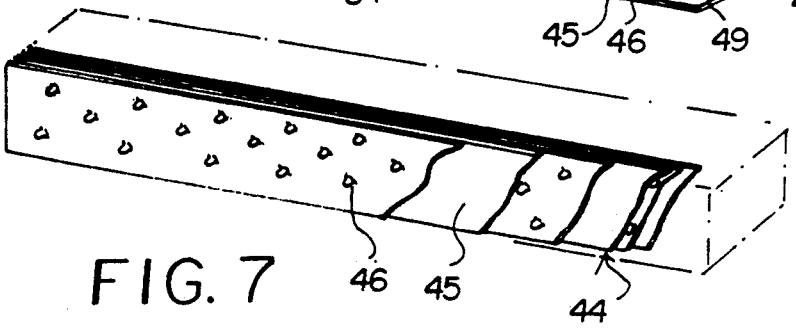
FIG. 7

AIR CONDITIONING SYSTEM CONTAINING A PLASTIC DRAIN PAN

BACKGROUND OF THE INVENTION

1. Field of the Invention

The present invention relates to an air conditioning system containing a plastic drain pan and more particularly, to an air conditioning assembly containing a plastic drain pan assembled with a fan cover hanging bracket and a coil supporting bracket for tightly receiving an air conditioning coil with a pair of plastic hand units, and an air cleaner.

2. Description of the Prior Art

Various types of air conditioners are well known in the art. Such air conditioners contain a drain pan made of steel which is directly mounted to a fan cover and a motor. However, there are many problems with the prior art air conditioners, that is, (1) the metallic primary pan eventually becomes rusty and clogs up the outlet for draining water from the drain pan; (2) it is difficult for the drain pan to support the air conditioner because of the additional weight caused by the metal pan; and (3) electric leakage is developed since the drain pan and a hanger for the motor are made of metal which, when in contact with wires from the motor, contributes to the leakage.

In order to avoid such problems, U.S. Pat. No. 4,597,269, U.S. Pat. No. 4,823,558, U.S. Pat. No. 4,862,704, and U.S. Pat. No. 4,916,919 disclose a plastic primary pan for use in conjunction with air conditioners. However, these air conditioners assembled with such prior plastic primary pans suffer from a number of disadvantages such as, for example, (1) since generally the air conditioning coil is put on the interior of the plastic primary pan, it is very difficult to take out the primary pan therefrom for a repair of a replacement; (2) since the condensate water falls down directly on the inner bottom of the primary pan, an amount of condensate water is gathered on the outer bottom of the primary pan; (3) since the air conditioning coil is disposed over the interior of the primary pan in order to easily take out the primary pan from the air conditioner, the air blow stream from an air outlet of the fan cover can escape through a space formed between the interior of the primary pan and the air conditioning coil; (4) since an air conditioning coil holder and an air conditioning coil seat are made of metal, it is very difficult to maintain a long life thereof because the metallic coil hand units and the coil seat become rusty; and (5) since there is no air cleaner disposed in the conventional air conditioner, the air conditioner is not expected to effectively perform continuous supplying and maintaining of fresh air indoors.

SUMMARY OF THE INVENTION

Accordingly, it is an object of the present invention to provide an improved air conditioning system containing a plastic drain pan assembly and an air cleaner disposed therein.

Another object of the present invention is to provide an improved drain pan assembly containing a plastic drain pan, a fan cover supporting bracket, and a coil supporting bracket disposed therein, wherein the drain pan assembly is assembled with an air cleaner for use in conjunction with an air conditioning system.

A further object of the present invention is to provide a drain pan assembly assembled with an air cleaner for use in an air conditioning system, includes a coil supporting bracket having a horizontally elongated slant valley for tightly receiving an air conditioning coil with a pair of plastic hand units and a plurality of the barriers for guiding air blow stream from an outlet of a fan cover to the air conditioning coil so as to achieve the effective cooling for the air conditioning system.

Still another object of the present invention is to provide an air conditioning coil supporting bracket closely put on the interior of a plastic drain pan for forming a double plate which contains the condensate water so as to prevent an amount of condensate water from gathering on the outer bottom of the drain pan.

Yet another object of the present invention is to provide an improved air conditioning system including an air cleaner for a more cleanly cooling air stream from the air conditioning coil disposed therein.

A further object of the present invention is to provide an air conditioning system which is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an air conditioning system containing an air cleaner and a plastic drain pan assembly which includes a drain pan, a fan cover supporting bracket having a plurality of slant barriers and a coil supporting bracket having a horizontally elongated slant valley for receiving an air conditioning coil at an angle.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a sectional view of FIG. 2, taken along line 4—4;

FIG. 5 is a perspective view of an air cleaner with a plurality of fins according to the present invention containing cut-away portions in order to illustrate the construction of the air cleaner of the present invention;

FIG. 6 is a perspective view of another embodiment of a portable air cleaner with a plurality of fins and a fin cover according to the present invention; and FIG. 7 is a perspective view of a plurality of filters of the air cleaner according to the present invention, containing cut-away portions in order to illustrate the construction of the air cleaner filters of the present invention.

DESCRIPTION OF THE PREFERRED EMBODIMENTS

Figure 1:
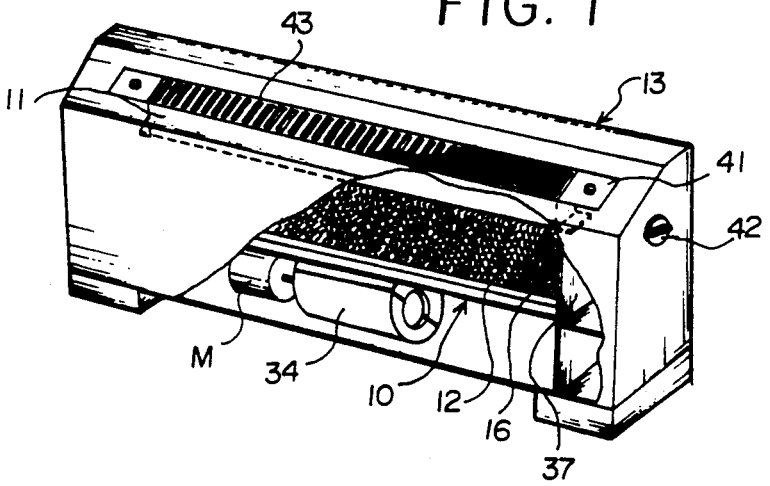
FIG. 1 is a perspective view of the air conditioning system containing an air cleaner and a plastic drain pan assembly according to the present invention containing cut-away portions in order to illustrate the construction of the air conditioning system of the present invention.
Figure 2:
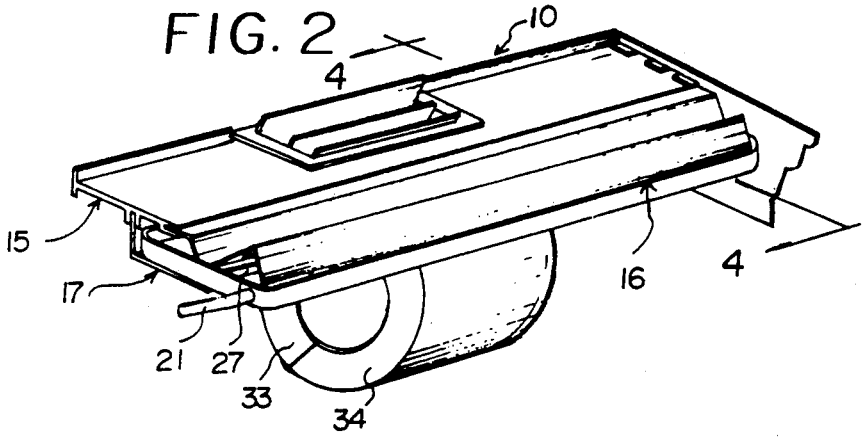
FIG. 2 is a perspective view of a plastic drain pan assembly showing the drain pan assembly assembled with a housing of the air conditioning system.
Figure 3:
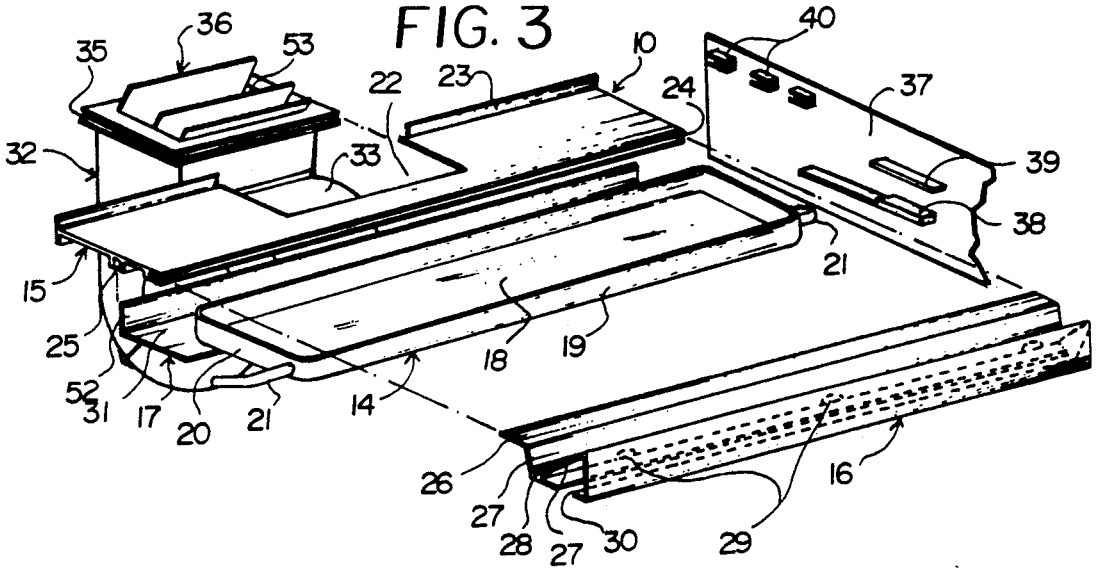
FIG. 3 is an exploded perspective view of the plastic drain pan assembly of FIG. 2.

Referring now in detail to the drawings for the purpose of illustrating preferred embodiments of the present invention, the air conditioning system containing an air cleaner and a plastic drain pan assembly as shown in FIGS. 1, 2 and 3, comprises a plastic drain pan assembly 10, an air cleaner 11, and an air conditioning coil 12 as a radiator disposed within a housing 13. The plastic drain pan assembly 10 includes a drain pan 14, a fan cover hanging bracket 15, a coil supporting bracket 16, and a drain pan supporting bracket 17 having an L-shaped configuration. The drain pan 14, fan cover hanging bracket 15, coil supporting bracket 16, and drain pan supporting bracket 17 are made of plastic.

The drain pan 14 made of plastic is provided with a pan body 18, a pair of front and rear walls 19, and a pair of side walls 20 having a pair of drain pipes 21 disposed on both side walls 20 thereof for draining condensate water. The fan cover supporting bracket 15 having a rectangular configuration is provided with a C-shaped top circumferential portion 22 disposed on one side of the rectangular configuration thereof, a pair of T-shaped rear extensions 23, a horizontally elongated front recess 24, and a horizontally elongated bottom recess 25 disposed in the outer bottom thereof.

The coil supporting bracket 16 contains a horizontal plate 26 which can be extended at the width thereof according to the width of the housing 13, an elongated valley 28 formed by a pair of slant side walls 27, and a plurality of drain apertures 29 and an elongated slit 30 for draining condensate water to the drain pan 14. The horizontal plate 26 is to be inserted into the elongated front recess 24 of the fan cover supporting bracket 15 (FIG. 4). The coil supporting bracket 16 is put on the interior of the drain pan 14 when the bracket 16 is assembled with the drain pan 14. At this time, the condensate water does not drop on the drain pan body 18 because of a double plate of both brackets 16 and 14. Therefore, condensate water is not gathered on the outer bottom of the drain pan 14 (FIG. 4).

As shown in FIGS. 3 and 4, the drain pan supporting bracket 17 has a base plate 31 for supporting the drain pan 14 and a side wall 52 for inserting into the elongated bottom recess 25 of the fan cover supporting bracket 15.

As shown in FIGS. 1 and 4, the air conditioning coil 12 contains a pair of plastic hand units 50. Since the hand units 50 are made of plastic, they have a long lifetime compared to conventional hand units made of metal.

As shown in FIGS. 2, 3, and 4, a fan cover 32 defined with an upper fan cover 33 and a lower fan cover 34 contains an air blow outlet 53 which has a circumferential recess 35 for slidably receiving the C-shaped top circumferential portion 22 and a plurality of barriers 36 for guiding the air blow stream to the air conditioning coil 12. At this time, the height of barriers 36 are gradually increased from the first front barrier 36 to the last rear barrier 36.

The housing 13 includes a pair of housing side walls having a pair of horizontally elongated lower shelves 38 and a pair of horizontally elongated upper shelves 39 for slidably receiving the drain pan 14 assembled with the drain pan supporting bracket 17. Also, the pair of housing side walls 37 has a pair of plurality of holding members 40 disposed thereon for slidably receiving both ends of the fan cover supporting bracket 15. As shown in FIG. 1, the housing 13 further includes an on/off switch 42, an access door 41, and a plurality of fins 43.

As shown in FIGS. 5 and 7, the air cleaner 11 is attached to the plurality of fins 43 and may be the air cleaner is provided with a composite structure by attaching the fins thereto. The air cleaner housing 44 contains a plurality of filters 45 having a plurality of raised points 46 disposed on both surfaces thereof for forming a space between the filters 45. The treated air from the air conditioning coil 12 is to be cleaned through the plurality of filters 45 of the air cleaner housing 44.

Referring in detail to FIG. 6, there is illustrated an additional embodiment of an air cleaner construction in accordance with the present invention. The air cleaner 110 includes an air cleaner cover 47 with hinges 51, and a pair of attachments 48 disposed at both ends thereof and a plurality of screw apertures 49 so as to mount the fins of the conventional air conditioners thereon.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An air conditioning system including a motor and a fan, said air conditioning system comprising:

a plastic drain pan assembly including:

a drain pan provided with a pair of drain pipes disposed on both side walls thereof, a drain pan supporting plate having an L-shaped configuration for tightly supporting said drain pan, a fan cover hanging bracket containing a C-shaped circumferential portion, an elongated front recess, and an elongated bottom recess for slidably receiving a side wall of said drain pan supporting plate, a fan cover having a circumferential recess disposed on the top surface thereof for receiving said C-shaped circumferential portion and a plurality of barriers inwardly mounted on an air blow outlet, and a coil supporting bracket having an elongated valley, a horizontal extension extended from one side of said elongated valley for inserting into said elongated front recess of the fan cover hanging bracket, a plurality of draining holes disposed on said elongated valley, a housing having a pair of side walls, said each side wall including a pair of horizontal shelves for tightly receiving the assembled drain pan and drain pan supporting plate, and a plurality of holding members for tightly receiving said fan cover hanging bracket, an air conditioning coil having a pair of plastic hand units which is to be put on said coil supporting bracket, and an air cleaner disposed over said air conditioning coil, said air cleaner including a plurality of filters and fins, whereby the plastic pan assembly including air conditioning coil, can be easily mounted to and separated from the housing walls and under the air cleaner of the air conditioning system.

2. The air conditioning system of claim 1, wherein said fan cover hanging bracket is provided with a pair of T-shaped extension extended from the rear ends thereof for tightly inserting into the holding members of the housing walls.

3. The air conditioning system of claim 1, wherein said coil supporting bracket is provided with a horizontally elongated slit for communicating with said plurality of drainage holes for draining condensate water to the drain pan.

4. The air conditioning system of claim 1, wherein said plurality of filters are provided with a plurality of raised points disposed on both surfaces thereof for forming a space between filters.

5. The air conditioning system of claim 1, wherein said air cleaner includes an air cleaner cover and a pair of attachments disposed at both side ends thereof for attaching said air cleaner to the conventional air conditioning system.

* * * * *